US007077266B2

(12) United States Patent
Dietrich

(10) Patent No.: US 7,077,266 B2
(45) Date of Patent: Jul. 18, 2006

(54) TRAVEL ENCLOSURE FOR A GOLF BAG AND METHOD OF ASSEMBLING SUCH

(75) Inventor: Gregory B Dietrich, Orlando, FL (US)

(73) Assignee: Telebag, LLC, Orlando, FL (US)

( * ) Notice: Subject to any disclaimer, the term of this patent is extended or adjusted under 35 U.S.C. 154(b) by 47 days.

(21) Appl. No.: 10/741,088

(22) Filed: Dec. 19, 2003

(65) Prior Publication Data

US 2004/0195124 A1 Oct. 7, 2004

Related U.S. Application Data

(60) Provisional application No. 60/460,552, filed on Apr. 4, 2003.

(51) Int. Cl.
*A63B 55/08* (2006.01)
*A63B 55/00* (2006.01)

(52) U.S. Cl. ..... 206/315.4; 206/315.3; 220/8; 280/DIG. 6

(58) Field of Classification Search ..... 206/315.3, 206/315, 4; 150/159; 280/DIG. 6; 220/8
See application file for complete search history.

(56) References Cited

U.S. PATENT DOCUMENTS 375,498 A * 12/1887 McGuire ..... 220/8
1,252,775 A * 1/1918 Butcher ..... 220/8
1,325,692 A 12/1919 Cross
1,414,875 A * 5/1922 Hanaford ..... 206/315.4
1,918,447 A * 7/1933 Blatz ..... 206/315.5
4,078,594 A 3/1978 Oeckl
4,091,977 A * 5/1978 Luttbeg ..... 206/315.4
4,643,302 A * 2/1987 Baumgardner ..... 206/315.1
4,961,497 A 10/1990 Sherer et al.
5,383,505 A * 1/1995 Cordasco, Jr. ..... 150/159
5,450,956 A * 9/1995 Peckenpaugh et al. . 206/315.11
6,161,692 A * 12/2000 Lizarraga ..... 206/315.3
6,186,520 B1 * 2/2001 Barten ..... 280/30
6,205,823 B1 3/2001 Volk, Sr.
6,217,042 B1 4/2001 Kurtz et al.
6,315,115 B1 11/2001 Bradshaw et al.
6,367,625 B1 4/2002 Zobel
6,401,890 B1 * 6/2002 Tan ..... 190/107
6,595,356 B1 * 7/2003 Homoly ..... 206/315.3
6,763,940 B1 * 7/2004 Lai ..... 206/315.1
2002/0096518 A1 7/2002 Foster, Sr.
2004/0026281 A1 * 2/2004 Boardman et al. ..... 206/315.3

* cited by examiner

*Primary Examiner*—Sue A. Weaver
(74) *Attorney, Agent, or Firm*—James H. Beusse; Beusse Wolter Sanks Mora & Maire, P.A.

(57) ABSTRACT

A travel enclosure for a golf bag has a support for the golf bag and a set of nested members arranged for telescopic movement with respect to each other and the support between remotely spaced positions disassociated from the support and at least partially enclosing positions in association with the support about the golf bag. One of the nested members being engaged with the support upon the telescopic movement of the nested members into their at least partially closing position.

21 Claims, 5 Drawing Sheets

TRAVEL ENCLOSURE FOR A GOLF BAG AND METHOD OF ASSEMBLING SUCH

CROSS REFERENCE TO RELATED APPLICATIONS

This application claims the benefit of U.S. Provisional Application, Application No. 60/460,552 filed Apr. 4, 2003.

FIELD OF THE INVENTION

The present invention relates in general to travel enclosures for a golf bag and in particular to those utilizing hard sided telescopically movable members for protecting the golf bag during transportation. A method of assembling a travel container is also disclosed.

BACKGROUND OF THE INVENTION

In the past, various different schemes were employed to provide a hard sided travel enclosure for golf bags in order to obviate damage by rough handling which may occur when the golf bag and attendant clubs stored in the golf bag were shipped by public transportation.

For instance, in some of the past travel enclosures, a pair of generally matching or mating hard case sections for receiving a golf bag and clubs were hinged together generally at adjacent side portions of the case section. Of course, when the hard core sections were moved into their mating positions, a chamber was formed between the hard core sections for receiving the golf bag and clubs, and at least one reliable securing device was interposed between the adjacent sides of the hard core sections to retain them against displacement when the hard core sections were moved about the hinged side portions thereof into their respective mating positions.

Further, with respect to past travel enclosures, there is illustrated in U.S. Pat. No. 6,367,625 issued Apr. 9, 2002 a hard protective sleeve disposed about the open end of a golf bag. The protective sleeve is slidably retained in various adjusted positions and a plurality of clips inserted over the side of the golf bag adjacent the open end thereof in order to adjust the length of the golf bag to accommodate various different lengths of attendant golf clubs received in the golf bag through the open end thereof. In the adjusted positions of the protective sleeve relative to the open end of the golf bag, a top may be received on the protective sleeve to enclose a free or adjusted end thereof which is adjustably spaced beyond the open end of the golf bag.

Still further with respect to past travel enclosures, there is shown in U.S. Pat. No. 4,961,497 issued Oct. 9, 1990 a golf bag container having upper and lower generally cylindric hard bodies arranged for telescopic association with said upper and lower bodies and having an open end and a closed end, and the open ends of the upper and lower bodies are configured to provide a union therebetween. When the upper and lower bodies are in enclosing positions, this union permits the open ends of the upper and lower bodies to be joined with only a short section of the upper body being telescopically received through the open end of the lower body. Latch members are associated with the union for releasably retaining the upper and lower bodies in the enclosing positions thereof providing an enclosed protective chamber for the golf bag and attendant golf clubs carried within the enclosed protective chamber. In an inverted configuration of the upper body, the union permits the open end of the upper and lower bodies to be joined with a substantial section of the upper body being telescopically received through the open end of the lower body. Thus, the upper body can at least in part be stored within the lower body and the golf bag can be placed inside the upper body in its inverted configuration.

Another of the past travel enclosures is shown in U.S. Pat. No. 4,078,594 issued Mar. 14, 1978 and includes a projecting sleeve bonded to a base sleeve and extending therefrom with a golf bag being received in a chamber formed by the bonded together base and projecting sleeve. An adjustable sleeve is slidably received about the projecting sleeve, and a pair of abutments fixedly secured about the base sleeve and adjustable sleeve are abutted together in order to maintain the upper ends of the projecting sleeve and adjustable sleeve generally in axial alignment with each other. Therefore, with the golf bag received in the chamber formed by the base and projecting sleeves, the attendant golf clubs of the golf bag extend exteriorly through the upper ends of projecting and adjustable sleeves so as to be available to a golfer for play. When the abutment or the base and adjustable sleeves are abutted in engagement, a releasable securing device retains the adjustable sleeve against displacement movement relative to the base sleeve, and the releasable securing device is operable to retain the adjustable sleeve in a position manually displaced on the projecting sleeve from the base sleeve. Upon the manual movement of the adjustable sleeve to its displaced position, the upper or open end of the adjustable sleeve extends generally axially beyond the golf clubs in the golf bag, and a lid is removably secured to the adjustable sleeve adjacent its open end. Therefore, golf bag and the attendant golf clubs are dispersed within the base sleeve, the projecting sleeve and the displaced adjustable sleeve to protect said bag and clubs against damage by rough handling during shipment or public transportation.

SUMMARY OF THE INVENTION

A travel enclosure for a golf bag is provided in one form of the invention with supporting means for the golf bag, and a set of nested means is arranged for telescopic movement with respect to each other and the supporting means between remotely spaced positions disassociated from the supporting means and at least partially enclosing positions in association with the supporting means about the golf bag. One of the nested means includes engagement means for engagement with the supporting means upon the telescopic movement of the nested means from their remotely spaced positions into their at least partially enclosed positions in association with the supporting means.

A method of assembling a travel enclosure in one form of the invention is also disclosed.

DETAILED DESCRIPTION OF THE PREFERRED EMBODIMENTS

Figure 1:
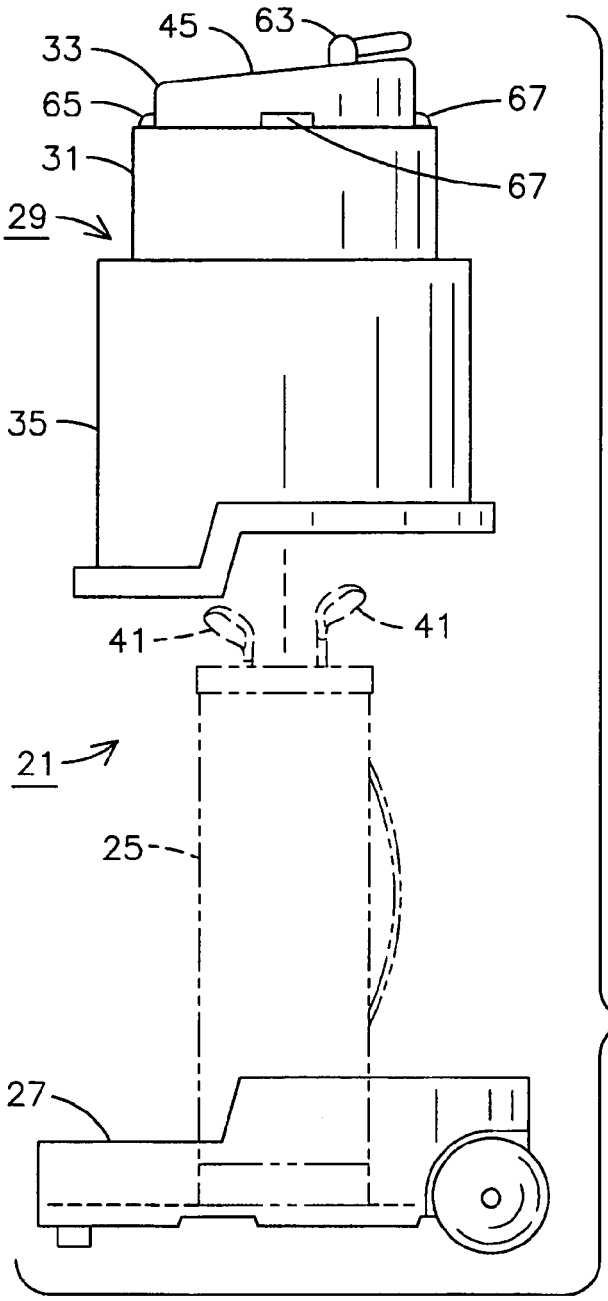
FIG. 1 is an exploded view of a travel enclosure for a golf bag illustrating the disposition of a set of nested members in a remote position displaced from a support for the golf bag during the assembly method for the travel enclosure.
Figure 2:
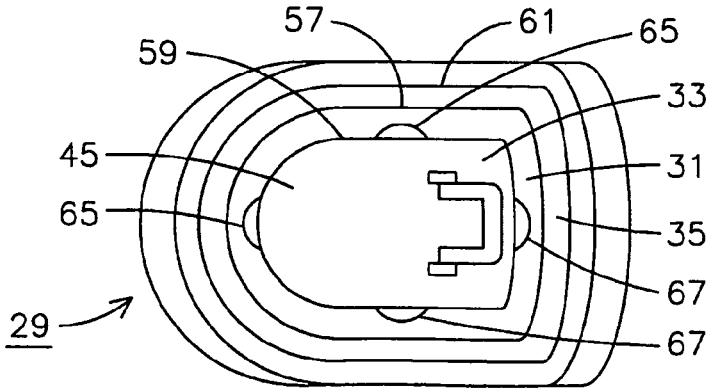
FIG. 2 is a top elevational view of the nested members taken from FIG. 1 in order to generally illustrate the shapes thereof.
Figure 3:
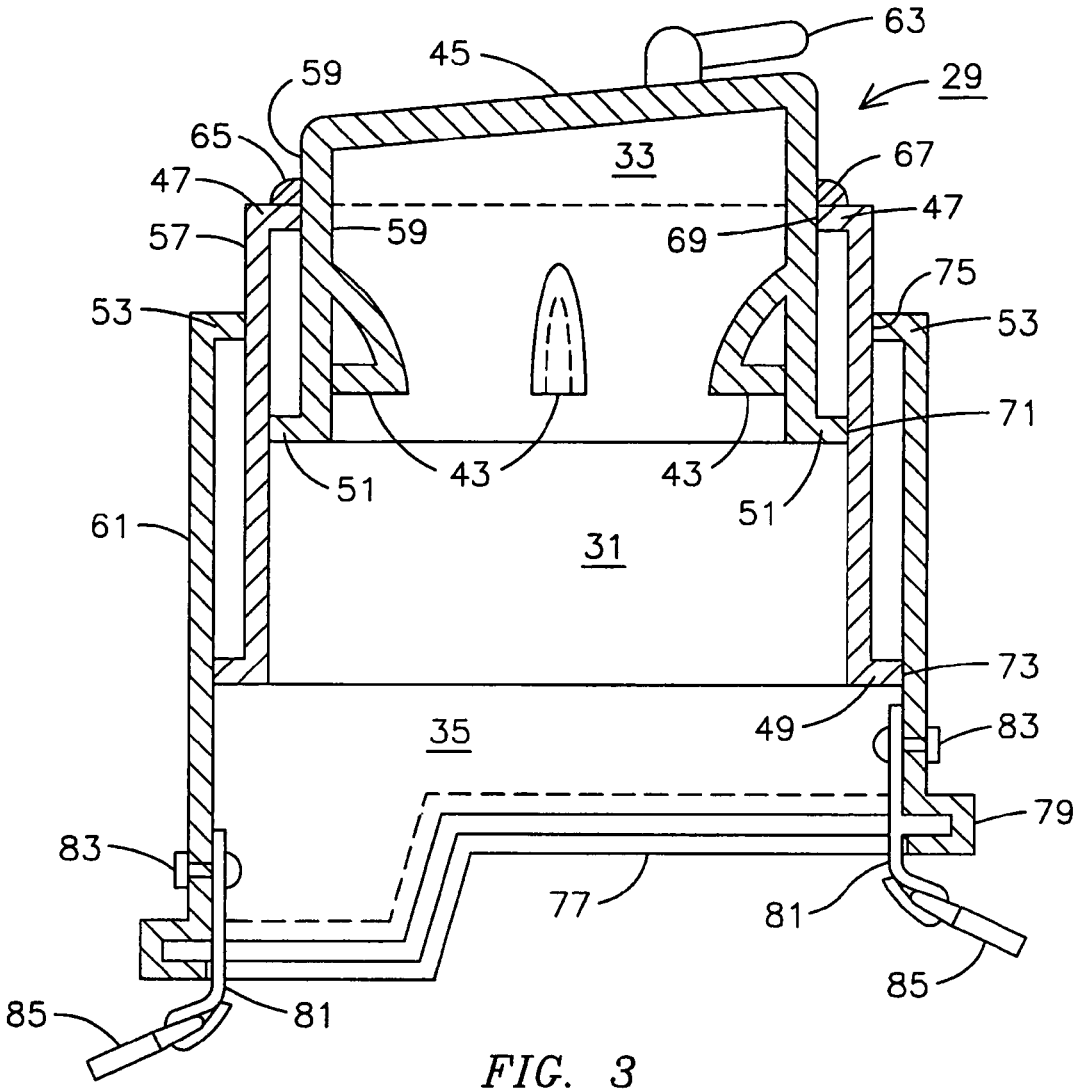
FIG. 3 is an enlarged sectional view of the nested members nested together in their nested position as shown in FIG. 1 with the nested members being shown in cross-section.
Figure 4:
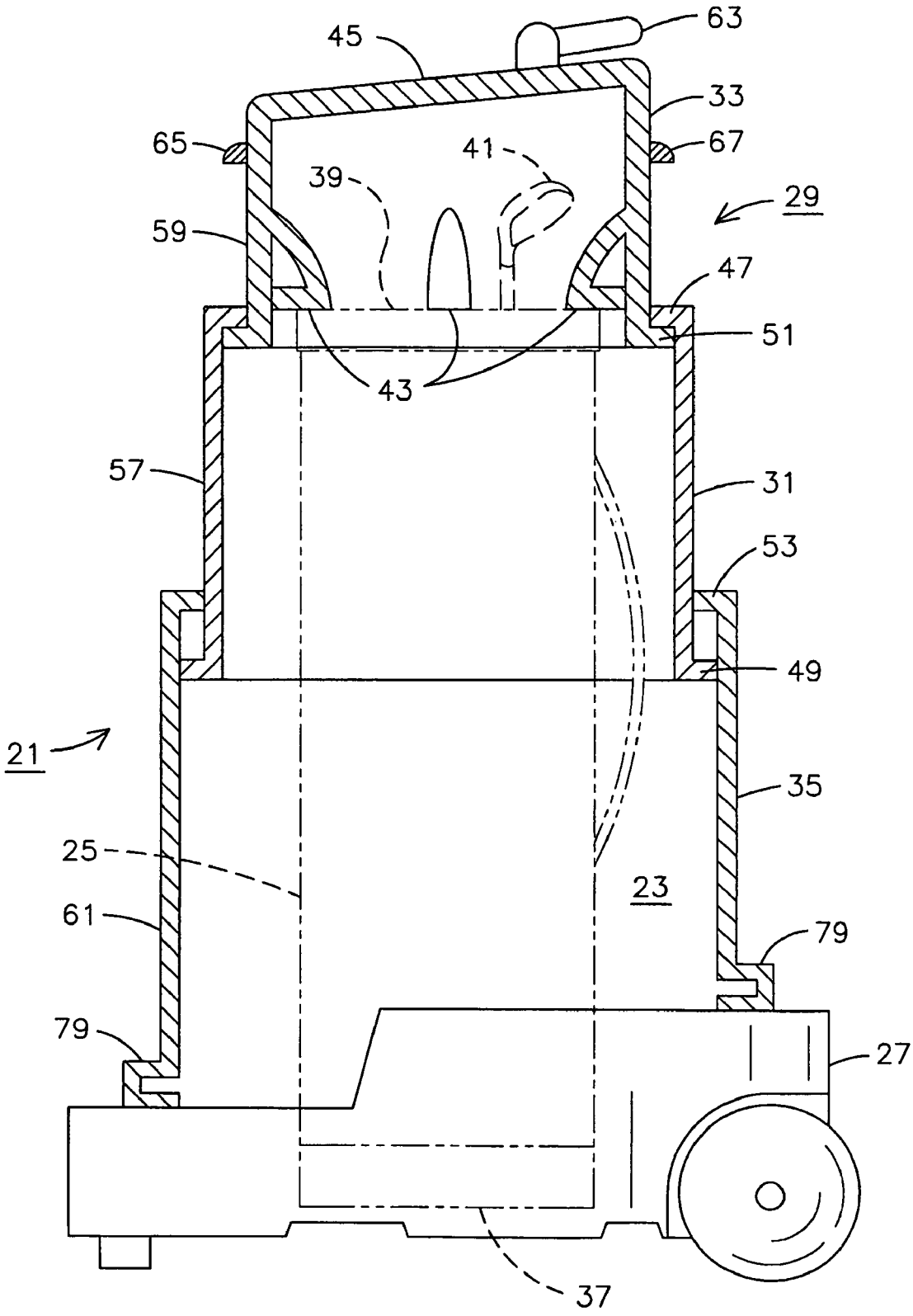
FIG. 4 is a view partially in cross-section illustrating the telescopic movement of the nested members into association with the support to define a chamber therebetween in which the golf bag is enclosed.

Referring now to the drawings in detail and in particular to FIGS. 1–4, there is shown in one form of the invention a method of assembling a travel enclosure 21 to form at least in part an enclosed chamber 23 therein for receiving a generally elongate golf bag 25 as illustrated in dotted outline herein. Travel enclosure 21 has supporting means, such as a support or support member 27, for golf bag 25 and a set of containers or nested means or members 29. When arranged or assembled in a nested position, nested means 29 includes an intermediate member 31 interposed between upper and lower end members 33,35 (as seen in FIGS. 1 and 2) which are telescopically movable from the nested position thereof with respect to each other and with respect to said support member. In the practicing of this method, nested members 29, in their nested positions, are manually supported or placed so as to be arranged or otherwise manually located in a remote position displaced or otherwise spaced from support member 27, as seen in FIG. 1. Upon the release of the aforementioned manual support from nested members 29, the telescopic movement of said nested members is effected from their remote positions toward support member 27, as best seen in FIG. 4. It may be noted that nested members 29 are dropped or otherwise released so as to fall from their remote positions toward support member 27 upon the release of the above-discussed manual support from said nested members. In response to this aforementioned telescopic movement of nested members 29, lower end member 35 of said nested members is associated or otherwise disposed in engagement with support member 27 as discussed in greater detail hereinafter, and upon such association of said lower end member in engagement with support members 27, the at least in part enclosed chamber 23 is established or otherwise formed between said nested members and said support member.

With further reference to FIG. 1, it may be noted that golf bag 25 (as shown in dotted outline in the drawings) is preliminarily manually seated or otherwise disposed in a generally erect position on support 27, and of course, the golf bag is received within chamber 23 upon the telescopic movement of nested members 29 to engage lower end member 35 thereof with said support thereby to at least in part enclose the chamber about the golf bag, as shown in FIG. 4. Golf bag 25 is provided with a closed or lower end 37 and an open or upper end 39 through which golf clubs 41 may be received, and said closed end of the golf bag is seated in member 27 upon the disposition thereon of the golf bag in its generally erect position, as discussed hereinabove. Furthermore, when golf bag 25 is so seated on support 27, it may be noted that nested members 29 in their remote positions displaced from support 27 are spaced generally beyond open end 29 of the golf bag so that intermediate, upper end and lower end members 31,33,35 of the nested members are aligned or otherwise located in peripheral spaced relation and in axial spaced apart relation with said open end of said golf bag.

Figure 5:
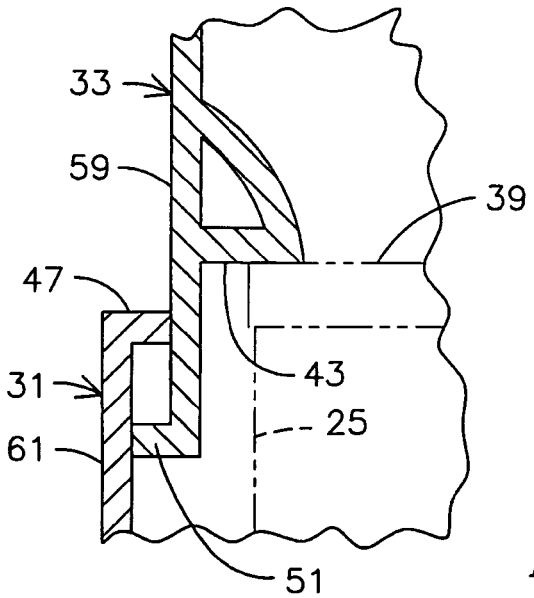
FIGS. 5–7 are enlarged partial views taken from FIG. 4.

Referring now to FIGS. 4 and 5, a set of abutments or abutment means 43 are integrally provided within upper end member 33, and said abutments engage with upper end 39 of golf bag 25 upon the aforementioned telescopic movement of nested members toward support 27. It may be noted that upper end member 33 is provided with a closed end portion, such as an integrally formed end or end wall 45 or the like for instance, and closed end wall 45 is predeterminately spaced above or beyond open end 39 of golf bag 25 upon the aforementioned engagements of abutments 43 with said open end of said golf bag in order to ensure the accommodation of attendant clubs 41 (shown in dotted outline) received in said golf bag and extending in part through said open end thereof.

Figure 6:
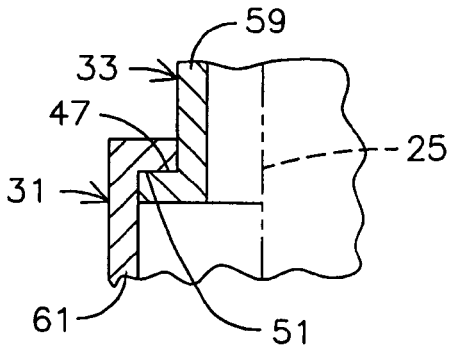
Figure 7:
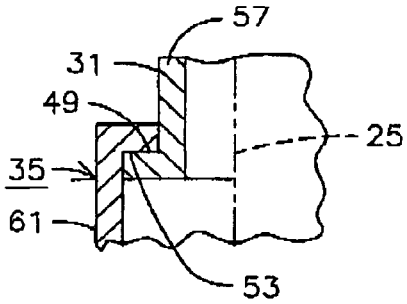

With further reference to FIGS. 4, 5 and additionally to FIGS. 6 and 7, intermediate member 31 of nested members 29 includes a set of spaced apart, generally peripheral abutments or abutment means 47, 49, and upon the aforementioned telescopic movement of said nested members, spaced abutments 47, 49 are respectively engaged with confronting parts on upper end member 31 and lower end member 35, such as for instance generally peripheral abutments 51,53 respectively as best seen in FIGS. 6 and 7. It may be noted that upon the telescopic movement of nested members 29 toward support 27, the respective engagements of spaced abutments 47,49 with abutment 51 on upper end member 31 and abutment 53 on lower end member 35 are effective for retaining said nested members against displacement from each other. The aforementioned telescopic movement of nested members 29 when restrained against displacement by the respective engagements of spaced abutments 47,49 with abutments 50,51 on upper and lower end members 33,35 occurs if said lower end member is not yet engaged with support 27.

Figure 8:
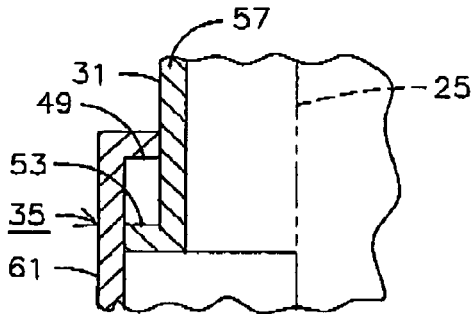
FIG. 8 is an enlarged partial view illustrating in cross-section an instantaneous position of intermediate and lower end members of the nested members during the telescopic movement t hereof.

When abutment 43 of upper end member 33 seats in engagement against upper end 39 of golf bag 25, as seen in FIG. 4, with abutments 47,51 of upper end member 33 and intermediate member 31 respectively engaged , as best seen in FIG. 6, the above described association or seating of lower end member 35 with support 27 is effective to interrupt the concerted telescopic movement of nested member 29 causing counter movement of lower end member 35 relative to intermediate member 31 to interrupt the engagements between abutments 49,53, as seen in FIG. 8. To complete the description of the aforementioned assembly method, a set of releasably securing means 55 of a type well known in the art are manually interconnected or otherwise engaged between lower end member 35 of nested members 29 and support 27 to respectively retain said lower end member and support against displacement from the assembled position or seating association thereof, and said releasably securing means as well as the assembled or seating association of said lower end member and support member are discussed in greater detail hereinafter.

To further describe the structure defining travel enclosure 21 in one form of the invention, intermediate member 31, upper end member 33 and lower end member 35 of nested members 29 are respectively provided with sidewalls 57,59, 61 each of a generally oval shape having a pair of opposed generally flat portions integrally interposed between a pair of opposed generally rounded portions, as best seen in FIG. 2 and as discussed in greater detail hereinafter. While the shapes or configurations of nested members 29 are described above merely for purposes of disclosure, it is contemplated that various other shapes or configurations may be utilized within the scope of the invention as defined by the claims which follow. Furthermore, while three nested members 29 are described above for purpose of disclosure, it is contemplated that a greater or lesser number of such nested members may be utilized within the scope of the inventions as defined by the claims which follow.

With reference to FIG. 3, closed end 45 of upper end members 33 is integrally formed with sidewall 59 thereof, and if desired a pivotal handle 63 of a structure well known to the art may be hinged or otherwise associated with said closed end exteriorly thereof in order to facilitate the aforementioned manual positioning of nested members 29 in their remote position displaced from support 27 as seen in FIG. 1. A pair of opposite abutments or abutment means 65, 67 are also integrally formed with upper end member 33 for engagement with peripheral abutment 47 on sidewall 57 of intermediate member 31 when retaining members 29 are in the aforementioned nested positions thereof. Peripheral abutment 47 extends generally peripherally inwardly of sidewalls 57 having a peripheral end or end surface 69 slidably and guidably arranged in engagement with sidewall 59 of upper end member 33 during the above described telescopic movement of nested members 29, and peripheral abutment 51 on said upper end members extends generally peripherally outwardly of sidewall 57 having a peripheral end or end surface 71 slidably and guidably arranged in sliding engagement with sidewall 57 of intermediate member 31 during such telescopic movement of said nesting members. Peripheral abutment 49 on intermediate member 31 extends generally peripherally outwardly of sidewall 57 having a peripheral end or end surface 73 slidably and guidably arranged in sliding engagement with sidewall 61 of lower end member 35 during the aforementioned telescopic movement of nested members 29, and peripheral abutment 53 on said lower end member extends generally peripherally inwardly of sidewall 61 having a peripheral end or end surface 75 slidably and guidably arranged in engagement with sidewall 57 of intermediate member 31 during such telescopic of said nested member.

Figure 10:
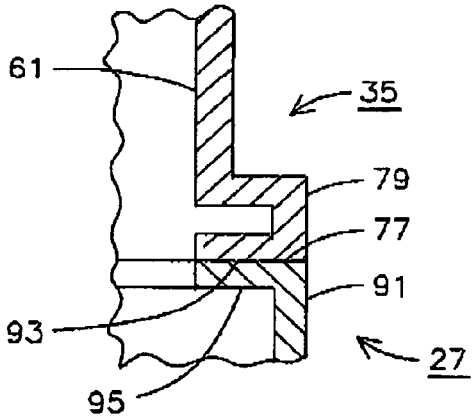
FIG. 10 is an enlarged sectional view taken along line 10-10 in FIG. 9.
Figure 9:
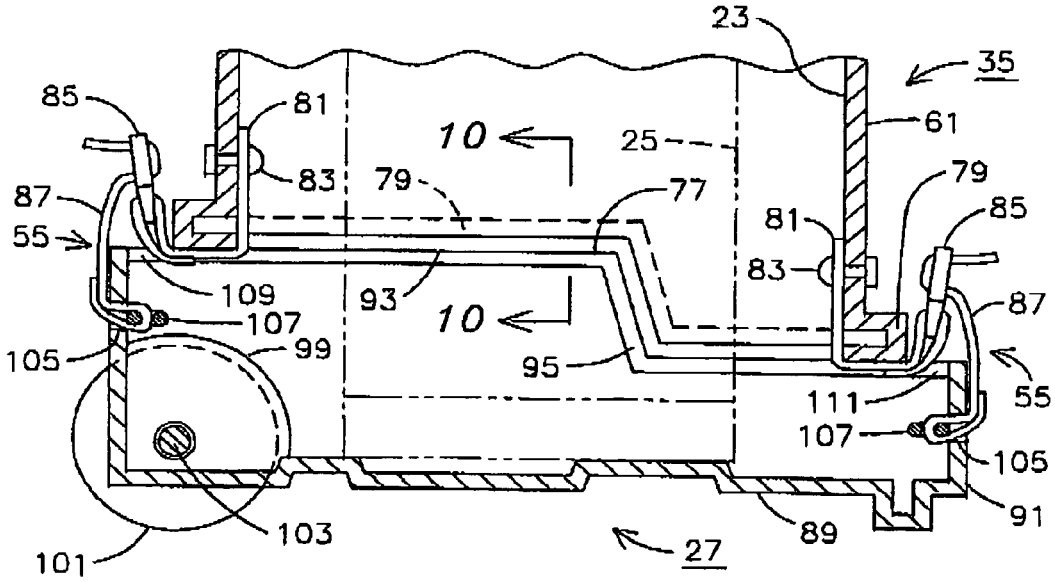
FIG. 9 is an enlarged partial view taken from FIG. 3 showing in cross-section the association in engagement of the lower end member of the nested members with the support.

As shown in FIGS. 3, 9 and 10 a peripheral seat or seating surface, such as for instance stepped abutment 77 is provided on a free side or leg of a reentrant flange 79 having a generally U-shape and which is integrally formed with sidewall 61 of lower end member so as to extend generally peripherally outwardly of sidewall 61. Reentrant flange 79 is configured to define a stepped lower end portion on lower end member 35. The aforementioned set of releasable securing means 55 each includes a strap 81 having one end fixedly secured to sidewall 61 of lower end member 35 generally adjacent peripheral reentrant flange 79 thereof by suitable securing means, such as a rivet 83 or the like for instance. To complete the description of nested member 29, the other or opposite end of each strap 81 extends exteriorly of lower end member 35 and is fixedly arranged to carry a buckle 85 or the like for instance, as well known in the art, which is adapted for releasable securement with another strap 87 carried by support 27, as best seen in FIG. 9 and discussed in greater detail hereinafter.

Figure 11:
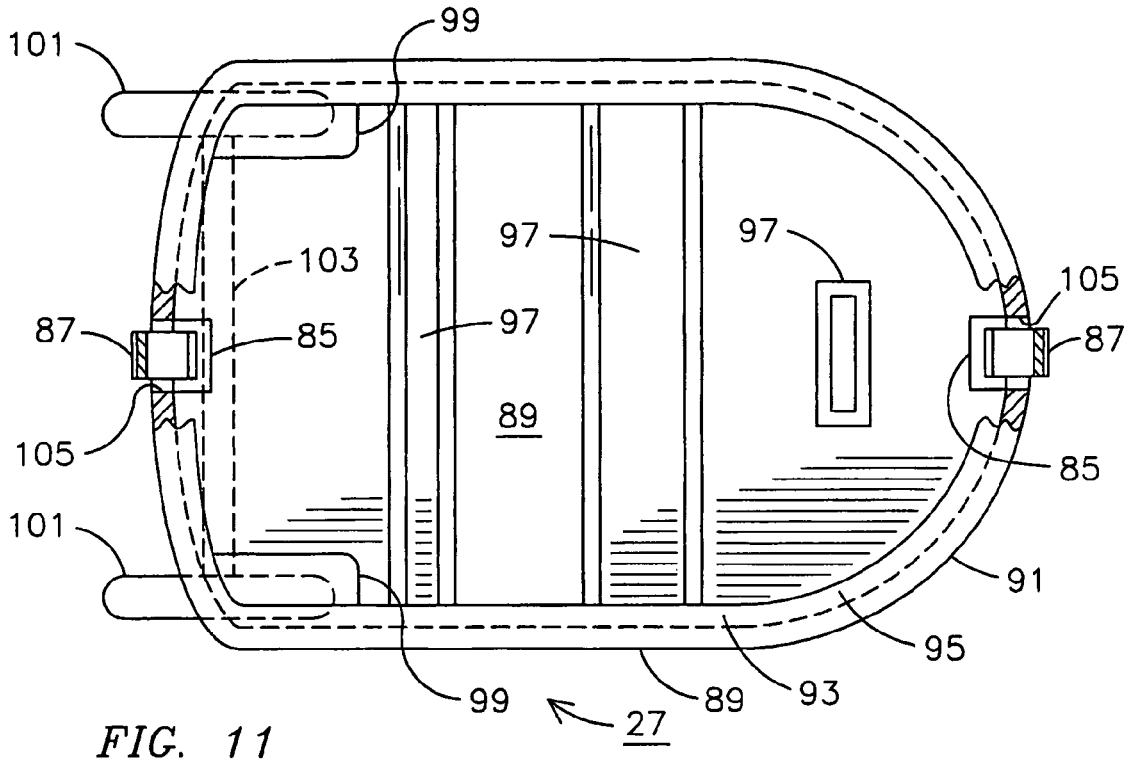
FIG. 11 is a plane view of the support taken from FIG. 9 to illustrate the shape thereof but disassociated from the nested members for purposes of clarity.

With reference now to FIGS. 9 and 11, support 27 of travel enclosure is provided with a base wall 89 integrally formed with a stepped sidewall 91 which extends generally peripherally about base wall 89. As previously mentioned with respect to sidewalls 57,59,61 of nested members 29, stepped sidewall 91 of support 27 is also provided with a pair of opposed generally flat portions integrally interposed between a pair of opposed generally rounded portions. A stepped abutment 93 is provided on a flange 95 integrally formed with stepped sidewall 91 so as to extend generally peripherally inwardly of said stepped sidewall thereby to define the upper free end thereof. A plurality of strengthening ribs 97 are integrally provided in base wall 89 for structural strength purposes. An opposite pair of opposite wheel wells 99 are integrally formed in base wall 89 and stepped sidewall 91 so as to be arranged exteriorly thereof, and a pair of opposite wheels 101 disposed in part within the exterior opposite wheel wells are rotatably carried on an axle 103 supported by stepped sidewall 91. A set of slots 105 extend through the aforementioned opposite generally rounded portion of stepped sidewall 91, and the aforementioned straps 87 extend through slots 105 exteriorly of support 27. To complete the description of support 27, each strap 87 carries a means, such as an abutment member 107 on the like, for displacement preventing engagement with a part of stepped sidewall 91 extending about slot 105 thereby to obviate displacement movement of each strap 87 through its associated slot 105.

Upon the aforementioned telescopic movement of nested members 29 to effect the seating engagement of lower end member 35 with support 27, as previously mentioned hereinbefore, chamber 23 defined between said nested member and said support is at least in part enclosed about golf bag 25, as further discussed hereinafter. When lower end member 35 and support 27 are so arranged in seating engagement, peripheral stepped abutment 77 on stepped reentrant flange 79 of said lower end member is in part disposed in seating engagement with peripheral stepped abutment 93 of stepped flange 95 on stepped sidewall 91 of support 27, as best seen in FIGS. 9 and 10. When abutments 77, 93 are in part seated or abutted in engagement, it may be noted that the opposite rounded portions of stepped sidewall 61 on lower end member 35 are predeterminately spaced apart from the corresponding opposite rounded portions of stepped sidewall 91 or support 27 thereby forming a set of means, such as openings or passages 109, 111 or the like for instance, for communicating chamber 23 exteriorly of nested means 29 and support 27.

With passages 109, 111 so established between lower end member 35 and support 27, as discussed above, a part of each strap 81 and its attendant buckle 85 mounted in association with stepped sidewall 61 of said lower end member may be respectively manually extended through passages 109, 111 exteriorly of said lower end member and said support, and a part of each strap 87 mounted in association with said support extending through slots 105 therein are manually inserted into displacement preventing engagement with said buckles, respectively. Thus, the respective displacement preventing engagement of straps 81, 87 with buckles 85 are effective to comprise the aforementioned set of releasable securing means 55 operable to retain lower end member 35 against displacement from its seating engagement with support 27.

While releasable securing means 55 are described hereinbefore only for purposes of disclosure, it is contemplated that various different releasable securing means well known in the art other than releasable securing means 85 may be utilized within the scope of the invention as defined by the claims which follow. Furthermore, while only two releasable securing means 85 are illustrated herein for purposes of disclosure, it is contemplated that a different number of such releasable securing means may be utilized within the scope of the invention as defined by the claims which follow.

Figure 12:
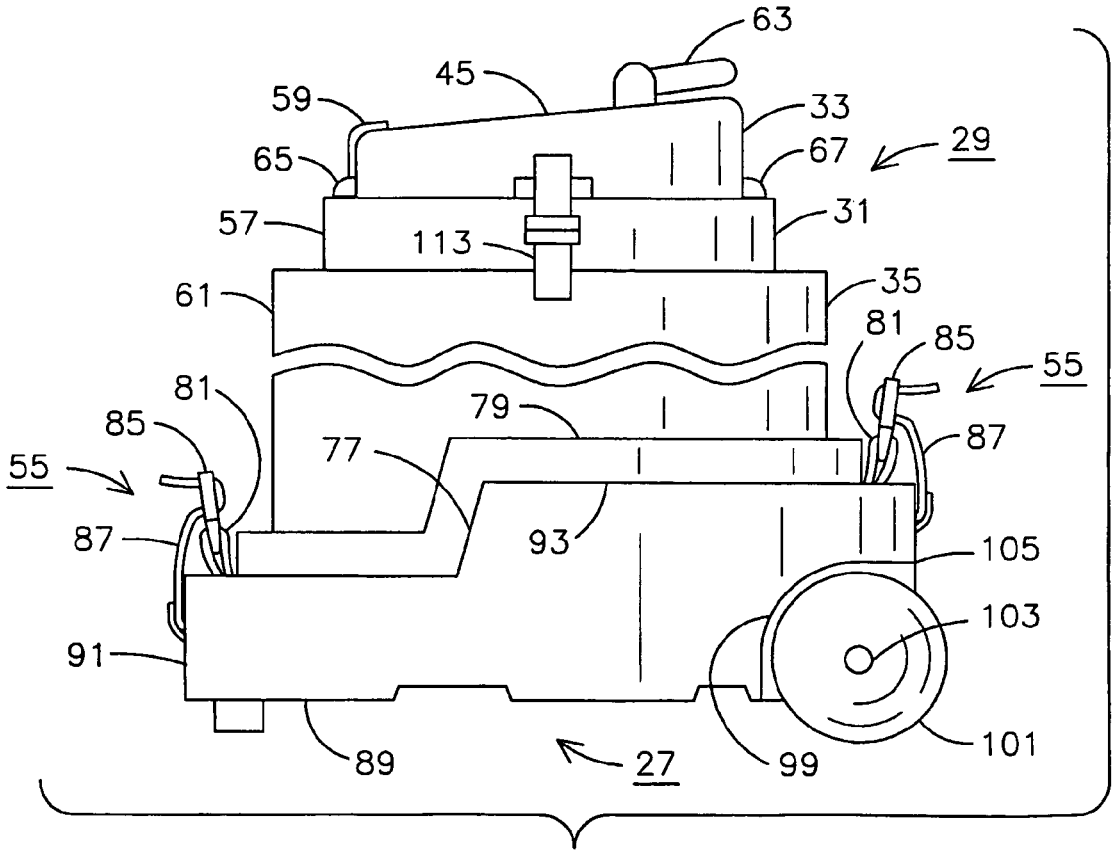
FIG. 12 is an elevational view of the travel enclosure assembled in a storage position with a portion of the nested members being broken away.

As shown in FIG. 12, travel enclosure 21 is illustrated in a storage position therefore disassociated from a golf bag so as to require a lesser space for storage.

With nested members 29 in their respective nested position (as also shown in FIG. 3), the nested members may be retained in such nested positions and manually moved toward support 27 to effect the above discussed seating engagement of lower end member 35 with support 27. Further, when lower end member 35 of nested members 29 is so seated with support 27, releasable securing means 55 may then be associated in the manner shown in FIG. 9 and discussed hereinabove to retain lower end member 35 against displacement from support 27 when nested members are in their respective nested positions. The aforementioned set of releasable securing means 55 may include another releasable securing means 113 of generally the same construction, and it may be noted that releasable securing means 113 is releasably interconnected between upper and lower end members 33, 35 in order to retain nested members 29 in their nested positions and against the aforementioned telescopic movement thereof. As previously mentioned, releasable securing means 55, 113 may be generally the same, the actual construction of releasable securing means 113 is omitted for purposes of drawing simplification and brevity of disclosure.

What is claimed is:

1. A travel enclosure for a golf bag comprising:

means for supporting the golf bag;

a set of nested means arranged for telescopic movement with respect to each other and said supporting means between remotely spaced positions disassociated from said supporting means and at least partially enclosing positions in association with said supporting means about the golf bag, and one of said nested means including means for engagement with said supporting means upon the telescopic movement of said nested means from their remotely spaced positions into their at least partially enclosing positions associated with said supporting means; and wherein another of said nested means includes means disposed for seating engagement with a part of the golf bag spaced beyond said supporting means upon the telescopic movement of said nested means into their respective at least partially enclosing positions.

2. The travel enclosure as set forth in claim 1 wherein a third one of said nested means is disposed intermediate said one and another nested means in the telescopic movement arrangement therewith, and said third one nested means including a set of spaced apart means for abutment with confronting parts on adjacent ones of said one and another nested means to retain said nested means against displacement from each other in response to the telescopic movement thereof, respectively.

3. The travel enclosure as set forth in claim 1 wherein said another nested means further includes an integrally formed end wall predeterminately spaced beyond the golf bag upon the engagement of said seating means with the golf bag part.

4. The travel enclosure as set forth in claim 1 further comprising a set of means for releasably securing said one nested means and said supporting means against displacement from their respective at least partially enclosing positions.

5. The travel enclosure as set forth in claim 4 further comprising a set of wheel means associated with said supporting means for effecting conjoint movement of said supporting means and said nested means in their respective at least partially enclosed positions in response to an applied force exerted on said nested means.

6. The travel enclosure as set forth in claim 1 further comprising an at least partially enclosed chamber means for the golf bag established between said supporting means and said nested means in the respective at least partially enclosing positions thereof.

7. A travel enclosure for carrying a golf bag comprising:

means for supporting the golf bag;.

a set of container means disposed generally in a nested arrangement for telescopic movement with respect to each other and with respect to said supporting means between remotely spaced positions disassociated from said supporting means and enclosing positions in association with said supporting means, one of said container means being slidably received in an intermediate one of said container means and said intermediate one container means being slidably received in another of said container means upon the telescopic movement of said container means from their remotely spaced positions toward their enclosing positions associated with said supporting means;

abutment means on said another container means for engagement at least in part with confronting parts of said supporting means upon the telescopic movement of said container means from their remotely spaced positions into their enclosing position;

chamber means disposed between said supporting means and said container means in their enclosing positions for at least in part enclosing the golf bag in response to the at least in part engagement of said abutment means with said confronting parts of said supporting means; and wherein said one container means includes a set of means for abutting engagement with a part of the golf bag upon the telescopic movement of said container means toward their enclosing positions.

8. The travel enclosure as set forth in claim 7 wherein said one container means includes a closed end defining a part of said chamber means, said closed end being predeterminately spaced beyond said golf bag upon the engagement of said abutting engagement means with the golf bag part.

9. The travel enclosure as set forth in claim 7 wherein said intermediate one container means includes a set of abutment means for respective engagement with confronting parts of adjacent ones of said one and another container means to retain said container means against displacement from each other upon the telescopic movement of said container means.

10. The travel enclosure as set forth in claim 7 further comprising a set of means for releasably securing said another container means and said supporting means against displacement when said abutment means are at least in part engaged with said confronting parts of said supporting means.

11. The travel enclosure as set forth in claim 10 wherein said supporting means includes a set of wheels.

12. The travel enclosure as set forth in claim 11 wherein said one container means include handle means arranged exteriorly thereon and responsive to an applied force exerted thereon for effecting movement of said supporting means on its wheels when said another container means and said supporting are secured against displacement by said releasably securing means.

13. The travel enclosure as set forth in claim 7 wherein said one container means includes a set of exteriorly arranged abutments arranged to engage with confronting exterior parts on said one intermediate container means, where said container means are in their nested arrangement.

14. The travel enclosure as set forth in claim 13 further comprising at least one means for releasably securing engagement between said one and another container means to retain said container means in their nested arrangement against the telescopic movement thereof.

15. A method of assembling a travel enclosure to form at least in part an enclosed chamber therein for receiving a generally elongate golf bag, the travel enclosure including a set of nested members telescopically movable with respect to each other, and a support member, the method comprising the steps of:

arranging the nested members in remote positions displaced from the support member;

effecting the telescopic movement of the nested members from their remote positions toward the support member;

associating one of the nested members in engagement with the support member in response to the effecting step;

establishing the at least in part enclosed chamber between the nested members and the support member upon the occurrence of the associating step; and wherein another of the nested members includes a set of abutments, and wherein the effecting step includes engaging the abutments with the open end of the golf bag.

16. The method as set forth in claim 15 further comprising the preliminary step of disposing the golf bag in a generally erect position on the support member with the golf bag being received within the at least in part enclosed chamber upon the occurrence of the establishing step.

17. The method as set forth in claim 16 wherein the golf bag has a closed end and an opposite open end through which golf clubs may be received, and wherein the preliminary step includes seating the closed end of the golf bag on the support member.

18. The method as set forth in claim 17 wherein the arranging step includes aligning the nested member in their remote positions generally adjacent the open end of the golf bag and generally in peripherally spaced relation therewith.

19. The method as set forth in claim 18 wherein the another nested member further includes a closed end portion and wherein the effecting step further includes predeterminately spacing the closed end portion of the another nested member beyond the open end of the golf bag upon the occurrence of the engaging step.

20. The method as set forth in claim 15 further comprising the additional step of releasably interconnecting the support member and the one nested member to retain them against displacement from the engagement effected during the associating step.

21. The method as set forth in claim 15 wherein the nested member further includes an intermediate nested member interposed between the one nested member and another of the nested members with the intermediate nested member having a set of spaced apart abutments, and wherein the effecting step includes abutting the spaced apart abutments with confronting parts on the one and another nested members and retaining the nested members against displacement from each other upon the telescopic movement of the nested member.

* * * * *